United States Patent [19]

Ness

[11] 4,248,391

[45] Feb. 3, 1981

[54] HOLDER FOR ROLLS OF PAPER

[76] Inventor: Virginia V. Ness, 57 W. Shore Rd., Belvedere, Calif. 94920

[21] Appl. No.: 49,235

[22] Filed: Jun. 18, 1979

Related U.S. Application Data

[63] Continuation-in-part of Ser. No. 948,694, Oct. 5, 1978.

[51] Int. Cl.[3] ..... B65H 19/00

[52] U.S. Cl. ..... 242/55.54; 242/134; 242/141

[58] Field of Search ..... 242/55.2, 55.54, 68.4, 242/134, 129, 55.42; 248/467, 205 A, DIG. 5; 211/16

[56] References Cited

U.S. PATENT DOCUMENTS

| | | | |
|---|---|---|---|
| 589,053 | 8/1897 | Webster | 242/134 |
| 1,518,750 | 12/1924 | Nelson | 242/55.54 |
| 1,887,269 | 11/1932 | Knittle | 242/55.54 |
| 2,515,990 | 7/1950 | Dantzler | 242/55.2 |
| 2,523,951 | 9/1950 | Graumlich | 242/55.54 |
| 2,928,618 | 3/1960 | Locke | 242/55.54 |
| 3,370,805 | 2/1968 | Barbee | 242/55.42 |
| 3,806,057 | 4/1974 | Whatley | 242/55.54 |
| 4,106,723 | 8/1978 | Couture | 242/118.3 |

*Primary Examiner*—Leonard D. Christian
*Attorney, Agent, or Firm*—Owen, Wickersham & Erickson

[57] ABSTRACT

A holder for a paper towel roll or toilet paper roll. A stationary base member has an annular flat rim surrounding a central frustoconical projection. A rotatable member also has an annular flat rim surrounding a central hollow frustoconical projection that nests around the projection of the base member and is rotatable with respect thereto. The facing flat surfaces of the rim and the facing surfaces of the projections enable relative rotation with some resistance, to provide braking action. The outer surface of the frustoconical projection of the rotatable member includes means, such as splines, for firmly non-rotatably engaging the hollow core of a paper towel roll or toilet paper roll. The base member is secured horizontally, so that the rotatable member stands up vertically and holds the paper roll vertically.

18 Claims, 13 Drawing Figures

FIG. 6
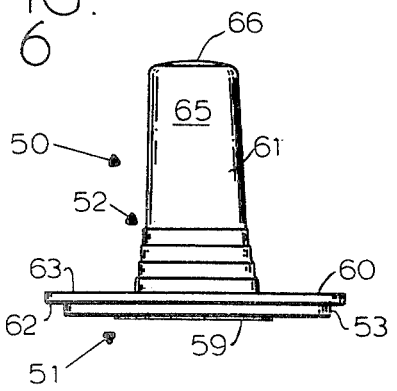
FIG. 7
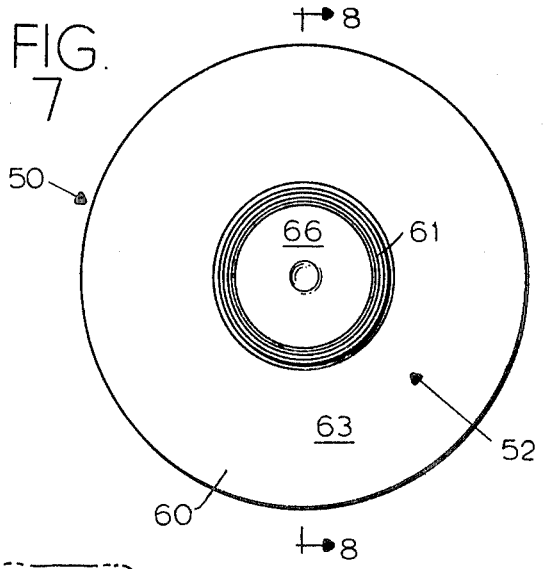
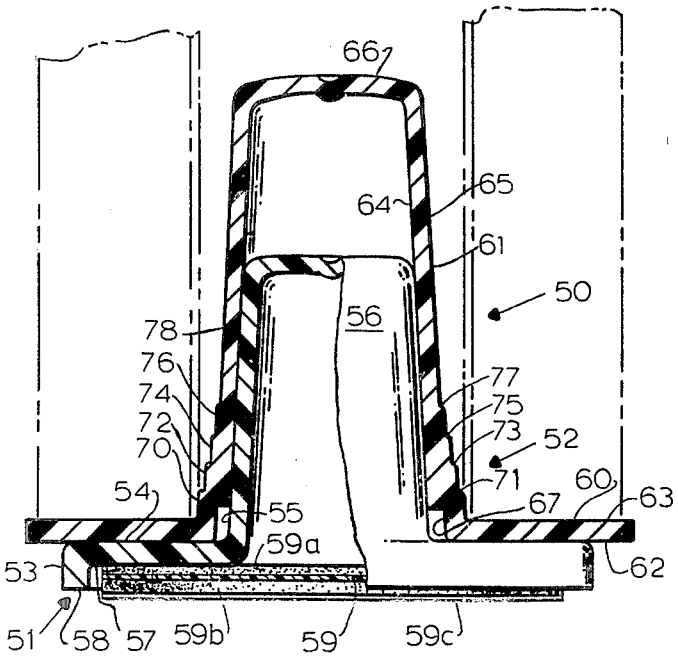
FIG. 8
FIG. 9
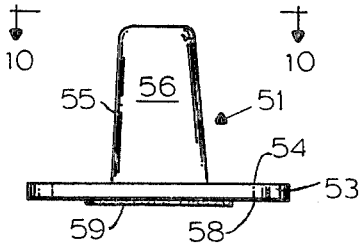
FIG. 10
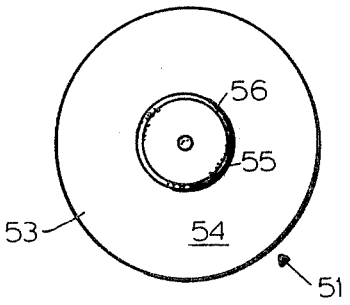

HOLDER FOR ROLLS OF PAPER

REFERENCE TO RELATED APPLICATION

This application is a continuation-in-part of application Ser. No. 948,694, filed Oct. 5, 1978.

BACKGROUND OF THE INVENTION

This invention relates to a holder for a roll of paper, such as a paper towel roll or a toilet paper roll, by which the roll is held vertically.

Current paper towel holders are in many instances unsatisfactory. They hold the roll horizontally and in order to do so are secured to a wall or other similar surface. Often, this means that they cannot be placed closely adjacent the place where they are needed. Many such devices are also inconvenient in that they require two-hand operation. Some holders fail to hold the paper rolls snugly enough, so that the rolls tend to fall out.

An important object of the present invention is to provide a holder for paper towels which can be held by any suitable horizontal or vertical surface and which holds the paper towel roll vertically. Such a device enables easy one-hand operation and is adaptable for many locations where horizontally-held rolls are not conveniently supported.

Another object of the invention is to provide a paper roll holder in which the roll is very easily installed and removed. Both paper towels and toilet paper, when held horizontally, normally require an installation which is somewhat time-consuming and sometimes very much so. In the present invention, installation is a matter of two or three seconds and the removal takes even less than that.

Other objects and advantages of the invention will appear from the following description of a preferred embodiment.

SUMMARY OF THE INVENTION

The invention comprises a paper roll holder made in two major elements. A stationary base member is provided having an annular horizontal rim and a central, preferably frustoconical, upwardly-extending projection. The projection need not necessarily always be frustoconical for this base member, but that is convenient. The surfaces of the rim are preferably flat and relatively smooth. Suitable securing means are attached which may be screws or ordinary adhesive, but preferably comprises a double-faced adhesive disc secured to the lower surface of the base rim with an adherent surface enabling its rapid attachment to a countertop. This adhesive surface may, of course, be covered with wax or treated paper or other similar material to enable handling prior to attachment. Alternatively, the base member may have a vertical securing portion for attachment to a vertical wall, with an horizontal shelf member from which the projection extends up vertically.

The other primary element of the device is a rotatable member having an annular rim much like that of the base member and with a smooth flat surface, usually in contact with the upper smooth surface of the rim of the base member. The rotatable member has a central hollow frustoconical projection, or at least a projection that is frustoconical on its outer surface. This projection nests around the projection of the base member and is freely rotatable with respect to it, the facing surfaces being quite smooth and presenting sufficiently low friction to each other to enable relative rotation with some resistance that applies a braking action. The outer surface of the frustoconical projection includes suitable means for firmly and non-rotatably engaging a hollow core of a paper towel roll or roll of toilet paper. This means may comprise simply the relative diameters of the projection and core, but may also include, for example, a series of splines. There may also be one or more steps on the outer surface of the projection to enable it to handle a wide variety of sizes of rolls. In addition, the step or steps may also include additional splines.

Thus, the base member can be adhesively secured (or secured otherwise, if desired) to a stationary horizontal supporting surface such as a countertop, or it may be secured to a wall and have an horizontal shelf portion. The base member is then stationary. The rotatable member, which is freely removable from the base member, is easily stuck into one end of the core of a paper towel roll or toilet paper roll and placed back over the base member. If desired, it need not even be removed, the old paper core being readily lifted off, torn off, or stripped from the projections and the new one forced down on top of it. When installed, the roll of paper and the rotatable upper member move together around the base, and it is easy to pull off one or more paper towels or sheets of toilet paper with one hand.

BRIEF DESCRIPTION OF THE DRAWINGS

In the drawings:

FIG. 6 is a view in side elevation of a modified form of assembly embodying the principles of the invention.

FIG. 7 is an enlarged plan view of the assembly of FIG. 6.

FIG. 8 is a further enlarged view in section taken along the line 8—8 in FIG. 7 and showing in broken lines a roll of paper towels.

FIG. 9 is a view in side elevation of the base of the assembly of FIGS. 6–8.

FIG. 10 is a plan view of the base of FIG. 9.

DESCRIPTION OF PREFERRED EMBODIMENTS

The Embodiment of FIGS. 1–5

Figure 1:
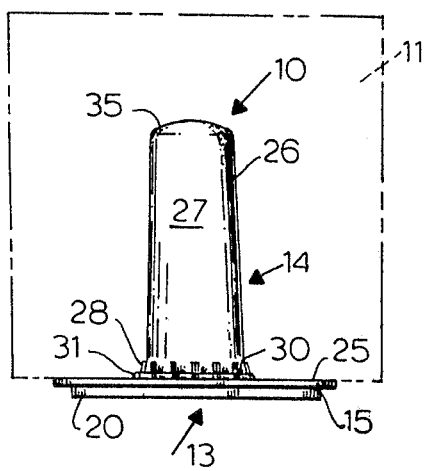
FIG. 1 is a view in side elevation of an assembly of the present invention with an installed roll of paper shown in broken lines around it.
Figure 2:
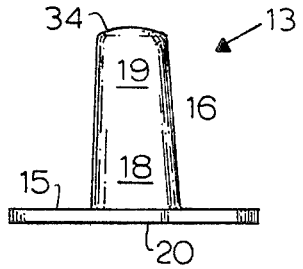
FIG. 2 is a view inside elevation of the base member alone.
Figure 3:
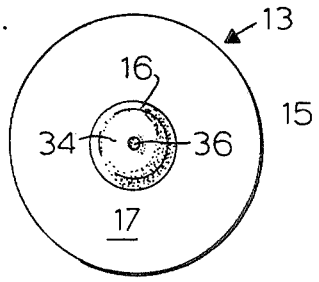
FIG. 3 is a top plan view of the base member.
Figure 4:
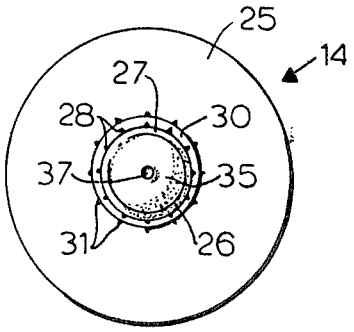
FIG. 4 is a top plan view of the rotatable member.
Figure 5:
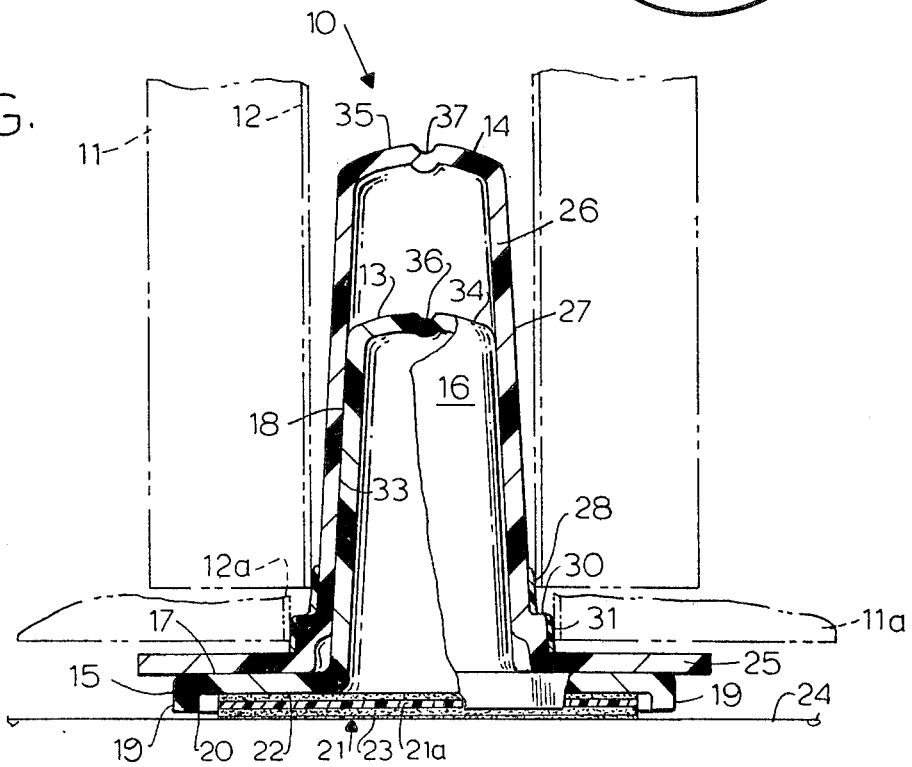
FIG. 5 is an enlarged view partly in section of the assembly with a portion of the supported roll shown thereon in broken lines.

FIGS. 1 to 5 show a plastic paper-roll holder 10 which can hold vertically either a roll 11 of paper towels or a roll of bathroom toilet tissues, the roll 11 having a cylindrical hollow cardboard core 12 (FIG. 5). A preferred plastic is high-impact polystyrene.

The holder 10 comprises two main members, namely, a stationary plastic base 13 and a rotatable upper plastic paper-holding member 14.

The base 13 comprises a generally flat circular plastic annulus or rim 15, preferably about 1/12 inch thick, and a central protrusion 16 which may, for example, be about 1¼ inch in diameter, about 1/12 inch thick, and extend about 2¼ inches high. The base 13 is provided so that its upper surface 17, both of the rim 15 and the outer surface 18 of the protrusion 16, presents low enough friction to enable rotation of the upper member 14, but enough friction to apply some braking action. Instead of being smooth, as shown, there may be one or more circumferential ribs, if desired, to help in achieving this controlled rotary motion, with braking, but with many plastics this is achieved with smooth surfaces, as it is with high-impact polystyrene. Thus, the upper surface 17 of the rim 15 and the surface 18 of the protrusion 16 provide surfaces on which the member 14 can freely rotate with some braking. Preferably, the protrusion 16 is frustoconical, at an angle of about 1° or 2°, e.g., 1°20′.

Preferably, the rim 15 has a downwardly extending outer circumferential lip 19, and a lower surface 20 of the rim 15 has a disc 21 (preferably three inches in diameter) of two-way adhesive secured to it. This disc 21 is preferably made of a sheet **21*a* of 1/16″ white plastic foam (e.g., polyethylene) coated on both sides with strong adhesive 22,23; it may come as a separate element when sold, with wax or treated paper covering the surface of both its upper adhesive layer 22 and its lower adhesive layer 23, or the upper adhesive layer 22 may be adhered prior to sale to the bottom surface 20 of the rim 15. The foam 21*a* provides a desired resiliency, withstanding shock, and also enables clean removal from a counter, by forcing a blunt knife into the foam and lifting up the base 13; the foam 21*a* is then sheared apart, and the adhesive 23 and the foam portion remaining with that are readily removed by a solvent, such as alcohol. In place of this convenient adhesive disc 21, which is preferably slightly thicker than the lip 19, e.g., 1/16″ for a lip thickness of about 1/20 inch, the device may be supplied without such a disc, and the user may either apply adhesive such as cement or may use screws with screw holes being provided in the rim, but the disc 21 has advantages that will be seen. The disc 21, or other suitable means, is then used to secure the base 13 to a suitable countertop 24, or other horizontal surface. Use of adhesive makes it possible to adhere it to any countertop whether of wood, plastic, formica, tile porcelain, or metal, without drilling any screw holes. In any event, the base 13** is then held stationary.

The upper rotatable plastic member 14 has an annular flat rim 25 about 1/10 inch thick and a central protrusion 26 which is preferably frustoconical to match the frustoconical protrusion 16, but, if desired, only the outer surface 27 of the protrusion 26 may be frustoconical. It preferably extends about 3 inches high and about 1/10 inch thick and has a gradation in diameter from about 1.5 inch at the bottom to about 1.4 inch at the top. This is an angle of about 1° or 2°, e.g., 1°20′. The purpose of this is to enable it to accommodate the various sizes and tolerances within those sizes of paper towel and tissue rolls 11 as they are made. The gradation of the central protrusion 26 enables it to accept all the now-manufactured cylindrical paper rolls or towels and tissues.

While this outer surface 27 may be relatively smooth, it should not be slippery, for it is intended to create a grabbing effect on the core 12 of the paper towel roll 11. To augment this grabbing effect, the protrusion 26 may be provided with a series of axially-extending projecting splines 28, although these are not essential. Also, other types of seizing devices may be used. Since some paper towel cores 12 are substantially larger interiorly than others (See, for example, the core **12*a* of the roll 11*a*), it is also preferred that the external surface, at least, of the protrusion 26 have a step 30 near its lower end. For example, this step 30 may be about ¼ inch high and about ⅛ inch wide, to give the portion below the step 30 a diameter of about 1.64 inch. There may be 12 splines 31 below the step 30, each measuring approximately a ¼ inch in length and each about 1/200 inch high. The protrusion 26 above the step 30 may have similar rigid splines 28**. These may be placed as the points of a clock, for example, 30° apart.

When assembled, the upper surface 17 of the rim 15 engages the lower surface 32 of the rim 25, while the outer surface 18 of the protrusion 16 engages the inner surface 33 of the protrusion 26. These engaging surfaces 17,32 and 18,33 may be smooth but not slippery. A circular rib may be present on one or more similar surface, but is not necessary, so long as good rotation and good braking action are assured, as they are by smooth, unslippery surfaces.

The upper ends 34 and 35 of both protrusions 16 and 26 may be solid. Preferably, they are slightly domed, as shown, and may, for molding convenience be shaped to provide a central dimple 36 or 37.

It will be evident that the device of this invention is readily installed and that the rotatable member 14 is also freely removable from the base member 13. This need not always be the case, but it is convenient. In this way, it may be removed for installation of a new paper towel roll 11 or for removing an old one, or the core 12 of an exhausted roll 11 may be simply pulled off the device or stripped from it in any suitable way and the new one placed on it. Usually with a slight push being sufficient to assure full seizure.

Once the paper roll is installed vertically, towels are usually removed, either one at a time or as a series, and the same thing applies to bathroom tissues. The roll 11 is held against rotation relative to the member 14 by installing its core 12 around the protrusion 26 until the roll 11 is fully seized by the member 14. When the member 14 is then reinstalled in the member 13, pulling a towel will cause the upper member 14 (and its roll 11) to rotate relatively to the base member 13, while there is sufficient braking action, so that a towel may be torn off the roll 11 without causing the member 14 and roll 11 to continue rotation and unwind unwanted towels.

The Embodiment of FIGS. 6 to 10

A plastic roll holder 50 of FIGS. 6 and 7 includes a stationary plastic base 51 and a rotatable member 52. The base 51 is generally like the base 13, having a rim 53 with an upper surface 54 and a central hollow frustoconical protrusion 55 with an outer surface 56. There is also a lower surface 57, preferably surrounded by an annular lip 58 and with an adhesive carrying plastic foam disc 59 secured thereto by an upper adhesive layer **59*a*, preferably with a non-adhesive sheet 59*c* covering its lower adhesive layer 59***b* and removable before installation.

The rotatable member 52 has a flange or base 60 up from which a protrusion 61 extends. There is a lower surface 62 and an upper surface 63 of the flange 60, and the hollow protrusion has an inner surface 64 and an outer surface 65, as well as an upper closed cap portion 66. The inner surface 64 is generally frustoconical with an offset portion 67 near the flange 60. The outer surface 65 is also generally frustoconical, but is provided with a series of steps of gradually decreasing diameter. Thus, there may be a lowest smooth frustoconical portion 70 which meets the flange 60, followed by a radially inward step 71 to a second smooth frustoconical portion 72, followed by another step 73 to a third smooth frustoconical portion 74, which is succeeded by an inner step 75 leading to a fourth smooth frustoconical portion 70, and the fourth portion 76 ends at an inward step 77 leading to the remaining smooth frustoconical portion 78 of the protrusion 61. This enables taking a number of different sizes of paper-towel cores. In this particular form of the invention there are no further projections like the splines 28, though there may be, if desired.

Figure 11:
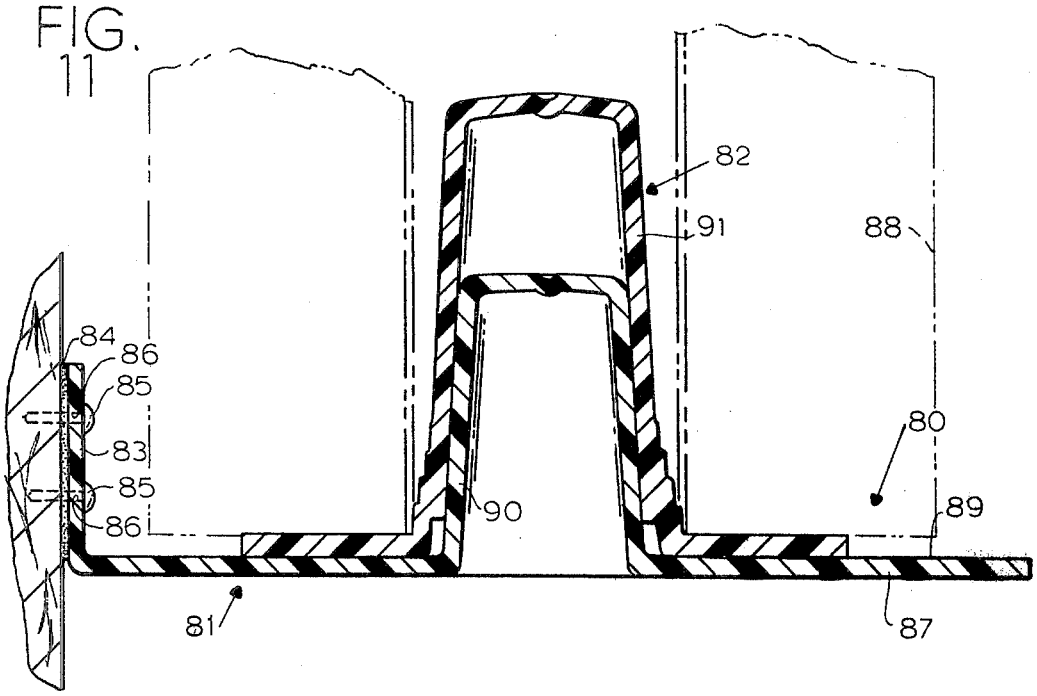
FIG. 11 is a view like FIGS. 5 and 8 of another modified assembly embodying the principles of the invention.
Figure 12:
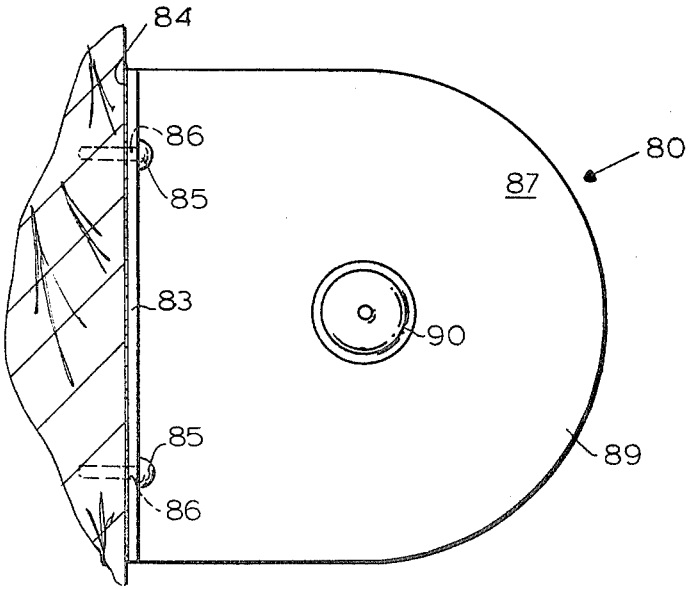
FIG. 12 is a plan view on a smaller scale of the base member of FIG. 11, with a portion of a house wall shown in section.
Figure 13:
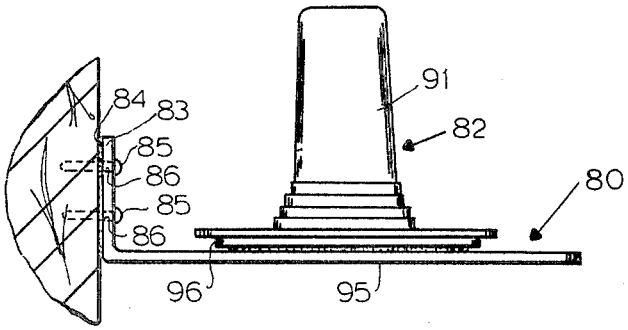
FIG. 13 is a view in side elevation of an assembly basically like that of FIGS. 11 and 12, with a portion of the supporting house wall shown in section, but made in three pieces instead of two.

The Embodiments of FIGS. 11 to 13

On occasions, countertop space is not available, and yet it is possible to provide a device having most of the advantages of the invention but suitable for wall mounting. FIGS. 11–13 show such applications of the invention. Again, an assembly 80 may be made in two main pieces, as shown in FIGS. 11 and 12, both of which may be molded plastic, such as high-impact polystyrene. In this instance, the assembly 80 comprises a base member 81 and an upper rotatable member 82.

The base member 11 includes a vertically-extending flange 83 which may be attached either by adhesive 84 or by screws 85 (FIG. 12) or by both (FIG. 11), the screws 85 extending through openings 86 provided in the vertical flange 83. The flange 83 is molded integrally with the remainder of the base 81 which also provides a shelf-like portion 87, much wider than the bases heretofore discussed, since such a base will have to accommodate the full outside width of the paper roll 88 (See FIG. 11). It is, therefore, made large and may be, for example, $6\frac{1}{2}$ inches in diameter. This acts, then, to form its own shelf. The base 81, in the form of the invention shown in FIGS. 11 and 12 has an upper surface 89, and a projection 90 which is frustoconical and preferably about $2\frac{1}{2}$ inches high.

The rotatable member or spindle 82 goes over the projection 90 and supports the roll 88, as heretofore. It may be substantially exactly like any of the forms heretofore shown. The structure of its frustoconical projection 91 may be in any of the already described forms or may be a somewhat different modification of them. Operation, so far as the part between the stationary base 81 and the rotatable spindle 82 are concerned, is that already described. If desired, the protrusion 90 from the base 81 may be placed off-center, for the outer portion of the roll 88 may need no extensive support.

If desired, as shown in FIG. 13, the base 81 may be made in two pieces, with a shelf member 95 integral with the flange 83, and a separate base member 96 adhesively secured thereto and substantially like the bases previously described.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A paper towel roll holder, including in combination:

a stationary base member having an annular horizontal rim surrounding a central frustoconical upwardly-extending protrusion, said rim having an upper surface on the same side as said protrusion and an adhesive-receptive surface on its other side, said protrusion having an outer surface, adhesive material adhered to said adhesive-receptive surface and able to adhere to a countertop, a rotatable member having an annular rim surrounding a central hollow frustoconical protrusion that nests around the protrusion of said base member and is rotatable with respect thereto, said rim having a surface facing the surface of said base member's rim, the outer surface of said frustoconical protrusion of said rotatable member acting as retention means for firmly non-rotatable engaging a hollow core of a paper towel roll, the facing surfaces of the two members being made low enough in mutual friction to enable relative rotation but having sufficient friction to result in a braking effect, whereby said base member can be adhesively adhered to a stationary horizontal supporting surface and wherein said rotatable member is removable from said base member and when installed is rotatable about it.

2. The holder of claim 1 wherein said retention means includes a circumferential series of splines on the outer surface of said protrusion of said rotatable member.

3. The holder of claim 1 wherein said retention means includes an outwardly stepped frustoconical portion of said protrusion of said rotatable member extending from said rim thereof and two circumferential series of splines, one series on the outer surface of the outwardly stepped portion and the other immediately thereabove.

4. The holder of claim 1 wherein said retention means comprises a series of successively frustoconical portions, all part of the outer surface of said frustoconical protrusion of the rotatable member, joined successively by a series of radially inwardly-extending steps.

5. The holder of claim 1 wherein said rim of said base member has a depending circumferential lip at its outer edge, said adhesive material being within the area encircled by said lip.

6. The holder of claim 5 wherein the adhesive material is a plastic foam disc slightly thicker than said lip and having strong adhesive on both faces.

7. The holder of claim 1 wherein said upper surface of said base member's rim and said lower surface of said rotatable member's rim are smooth but not slippery, to provide for rotation with braking action.

8. The holder of claim 7 wherein the outer surface of said base member's protrusion and the inner surface of said rotatable member's protrusion are smooth but not slippery, to provide for rotation with braking action.

9. A two-piece paper towel roll holder, including in combination:

a stationary base member of high-impact plastic having an annular rim surrounding a central hollow frustoconical projection, said rim having an upper surface on the same side as said projection, a rotatable member of high-impact plastic having an annular rim surrounding a central hollow projection that nests around the outer surface of the hollow projection of said base member in surface engagement therewith and is rotatable with respect thereto, said rim having a lower surface facing the upper surface of said base member's rim, the outer surface of said projection of said rotatable member being frustoconical and comprising retention means for firmly and non-rotatably engaging the hollow core of a paper towel roll, whereby said base member can be secured to a stationary supporting surface and said rotatable member is rotatable about said base member.

10. The holder of claim 9 wherein said frustoconical surface of said rotatable member is stepped outwardly adjacent said rim, the surface on each side of the step having a series of outwardly projecting splines thereon.

11. The holder of claim 9 having a series of projections extending out from said frustoconical outer surface of said rotatable member.

12. The holder of claim 9 wherein said frustoconical surface of said rotatable member has a series of successive inward steps leading from said rim, providing a series of successively smaller frustoconical outer surfaces.

13. The holder of claim 9 wherein said base member has a vertical flange extending up from one side of said rim, said flange having associated therewith, means for securing said flange to a vertical surface.

14. The holder of claim 9 wherein there is a shelf member having a vertical flange for attachment to a vertical surface, said base member being secured to said shelf member.

15. The holder of claim 9 having a sheet of plastic foam with an upper surface adhesively secured to the lower surface of said base member and an exposed adhesive layer secured to the lower surface of said sheet.

16. A paper towel roll holder, including in combination:

a stationary base of high-impact plastic, having a horizontal shelf with an upper surface, a vertical flange for attachment to a vertical surface, and a central hollow frustoconical projection, a rotatable member of high-impact plastic having an annular rim surrounding a central hollow projection that nests around the outer surface of the hollow projection of said base member in surface engagement therewith and is rotatable with respect thereto, said rim having a lower surface facing the upper surface of said base member's rim, the outer surface of said projection of said rotatable member being frustoconical and comprising retention means for firmly and non-rotatably engaging the hollow core of a paper towel roll.

17. The holder of claim 16 wherein the shelf and flange are one member and the central hollow projection is part of a separate member having a horizontal rim adhesively secured to said shelf.

18. The holder of claim 16 wherein the flange shelf and hollow projection comprise a single integral unitary base member.

* * * * *